United States Patent [19]

Walter

[11] 4,369,888

[45] Jan. 25, 1983

[54] CLOSURE FOR CONTAINER

[75] Inventor: John Walter, Evergreen Park, Ill.

[73] Assignee: The Continental Group, Inc., Stamford, Conn.

[21] Appl. No.: 242,756

[22] Filed: Mar. 11, 1981

[51] Int. Cl.[3] ..... B65D 39/04

[52] U.S. Cl. ..... 215/237; 220/307

[58] Field of Search ..... 215/237, 238; 220/307, 220/339

[56] References Cited

U.S. PATENT DOCUMENTS

| | | | |
|---|---|---|---|
| 3,021,976 | 2/1962 | Tracy | 220/307 X |
| 3,080,088 | 3/1963 | Corrinet | 220/307 X |
| 3,469,732 | 9/1969 | Foster | 220/339 X |

*Primary Examiner*—Donald F. Norton

*Attorney, Agent, or Firm*—John J. Kowalik

[57] ABSTRACT

A closure for a container having a neck with a bore which is provided with an annular locking shoulder having at diametrically opposite sides of the bore different shaped entry contours for guiding an annular locking shoulder on a plug, one of these shapes permitting easy entry of one side of the plug into the bore to tilt the plug and catch a portion of the plug shoulder at that one side beneath the neck shoulder to thus provide a fulcrum for the plug whereby upon applying force by pressing against the top of the plug at a point diametrically opposite to the fulcrum, the span of the plug between the fulcrum and the point functions as a lever which easily tilts the plug to upright position and forces the shoulders to slightly deform and the plug shoulder to snap under the neck shoulder.

10 Claims, 7 Drawing Figures

FIG. 1
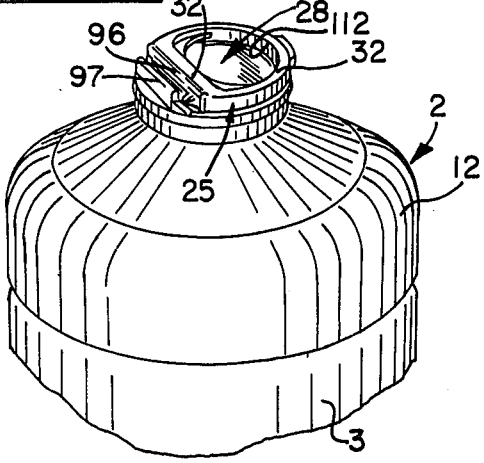
FIG. 2
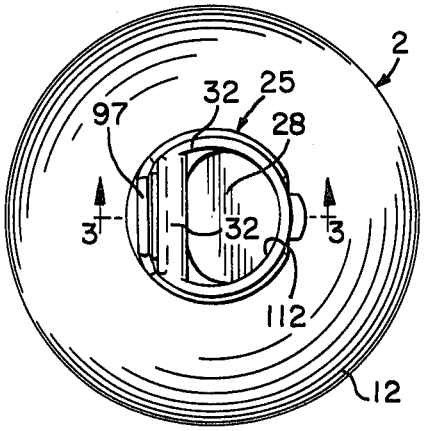
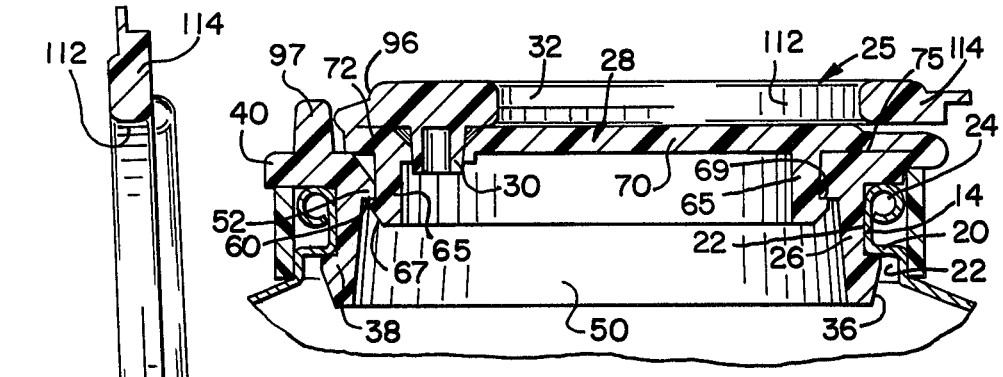
FIG. 3
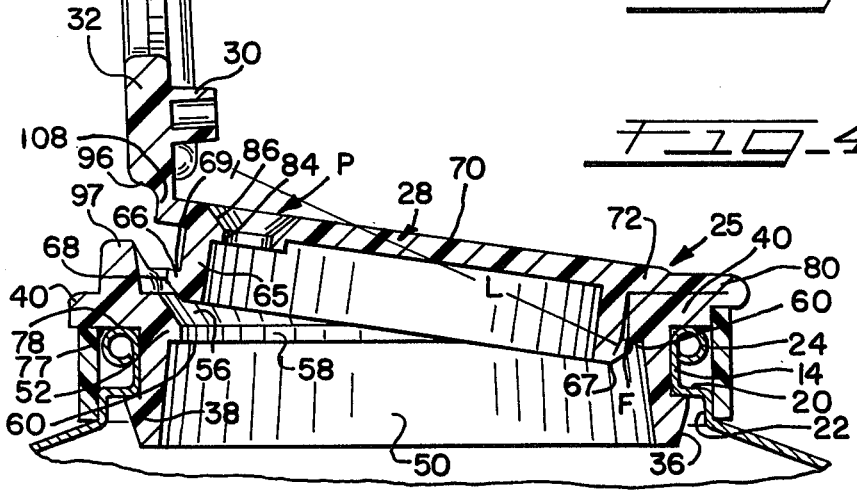
FIG. 4

CLOSURE FOR CONTAINER

BACKGROUND OF THE INVENTION

Containers of the type under consideration terminate in a narrow neck which is associated with a closure. Such types of closures are generally shown in U.S. Pat. Nos. 3,021,967 and 3,998,354; which are reclosable and to which the present invention apertains.

DESCRIPTION OF THE PROBLEM

The principal problem with the present reclosable closure is that the plug must be accurately aligned and wedged into the neck opening and the locking shoulders on the plug and the neck must be deflected by forcibly pressing on the top of the plug so that the shoulders are sufficiently deflected allowing the plug to enter into the neck bore whereupon the shoulders interlock. It is normally very difficult, if not impossible, for a young child or a woman to exert enough force to effect such closure. As a consequence, the container is usually left open thus deleteriously exposing the contents.

SOLUTION OF THE PROBLEM

The snap-in closure of the instant invention has been provided a novel structure which permits easy insertion of the plug into the bore and the interlocking of the locking shoulders. The structure guides the plug into the bore in a canted position and interlocking a portion of the shoulder on the plug partly under a portion of the shoulder on the neck. These portions which are hooked together provide a fulcrum for the plug at one side and the plug being canted invites the user to press down on the opposite or high side. The radial expanse of the plug serves as a lever between the fulcrum and the point of pressure and because of the mechanical advantage obtained, the plug is easily pivoted to an upright position in alignment with the neck bore and snapped down thus locking the shoulders.

SUMMARY OF THE INVENTION

This invention is directed to closures and, more particularly, to closures for pressurized products.

A main object of the invention is to provide a closure which may be easily inserted into the open end of a container and in which parts in the closed position are interlocked to maintain the closure from opening or leaking and upon the parts being separated after opening, they may be easily again closed and sealed.

A further object is to provide a novel closure having several parts tethered to each other and which are readily reclosable.

Another object is to provide a plastic closure which is made as a single unit in a simple molding operation.

Another object is to provide a novel arrangement of parts which are levered one against the other for easy reclosure with relatively small effort.

These and other objects inherent in and encompassed by the invention will become more apparent from the specification and the drawings wherein:

FIG. 1 is a fragmentary perspective view of the container incorporating the invention;

FIG. 2 is a top plan view thereof;

FIG. 3 is an enlarged fragmentary cross sectional view taken substantially on line 3—3 of FIG. 2;

FIG. 4 is a fragmentary sectional view similar to FIG. 3 showing the open position of the closure:

DESCRIPTION OF THE INVENTION

Figure 5:
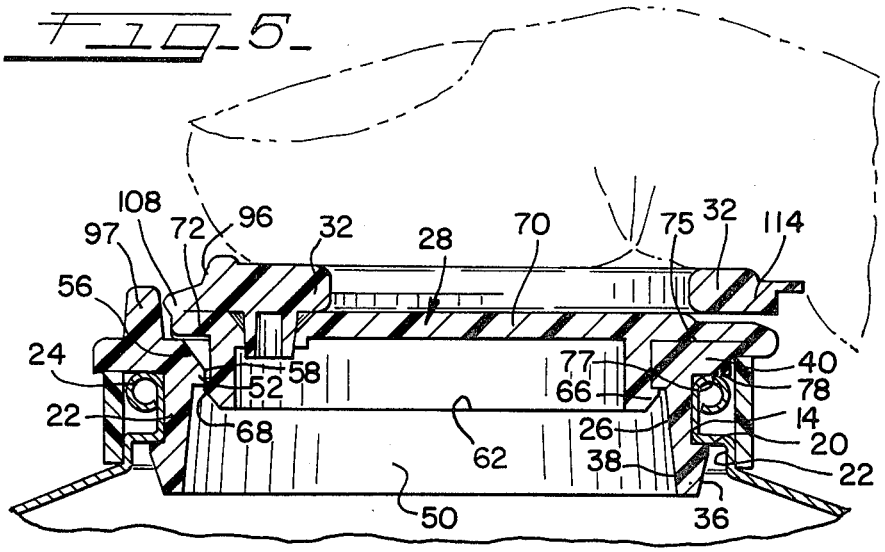
FIG. 5 is another fragmentary sectional view similar to FIG. 3 showing a closing position of the closure.

The invention is shown applied to a container 2 preferably made of metal such as aluminum and comprising a cylindrical body 3 with the usual integral bottom not shown. It will be understood that the invention is applicable to other types of containers which may be formed of glass or plastic.

A dome member 12 forms the upper end of the container.

The dome member 12 is formed with a stepped neck 14. The neck 14 provides a shoulder 20 at its lower end and an access opening 22 and has a curl 24 at its upper end.

A plastic closure 25 is provided at the upper end of the container and comprises a tubular neck fitment or sleeve portion 26, a closure plug portion 28 and a venting portion 30 to which is attached a finger grip lever or handle 32.

The neck portion 26 is a cylindrical member which at its lower end is tapered at 36 and is tightly wedged through the opening 22 (FIG. 3) and then expands radially outwardly and engages its shoulder 38 under the bottom edge of shoulder 20 of the neck 14.

The neck portion 26 has an upper outwardly projecting annular flange 40 which engages the top edge of the curl 24 and provides a fluid-tight pressure seal with the shoulder 38.

Figure 6:
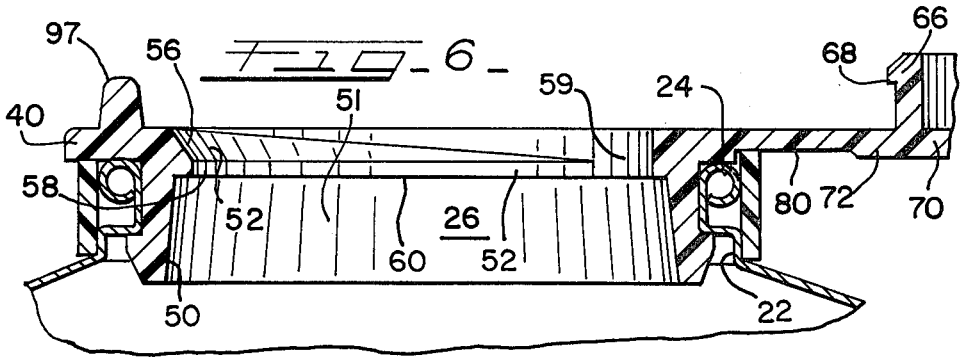
FIG. 6 is a further fragmentary sectional view similar to FIG. 3 showing the open position of the closure parts being broken off.
Figure 7:
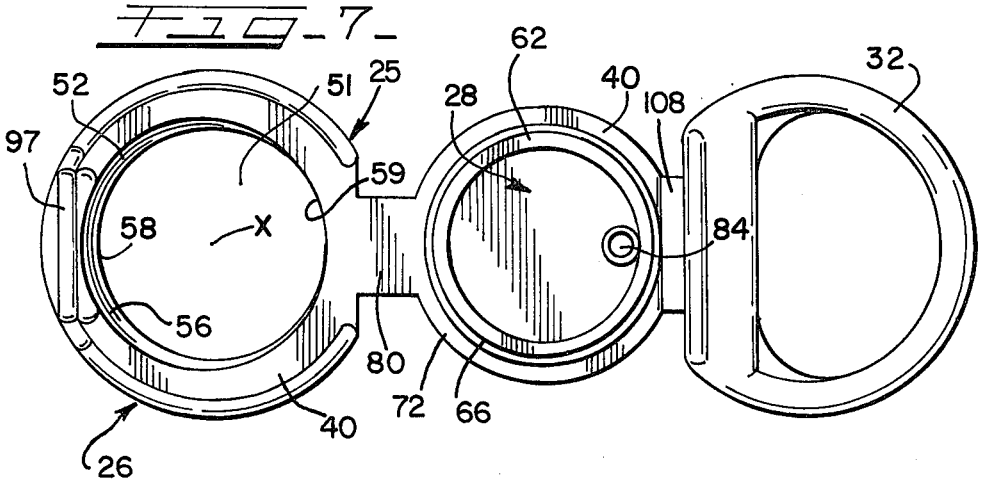
FIG. 7 is a top view on a different scale of the closure in open position.

An interior bore surface 50 of the neck portion provides a pour and fill opening 51 and is provided with a deformable locking ring member or shoulder 52 which at one diametrical side has a downwardly sloping upper C-shaped surface 56 (FIGS. 6 and 7) in top plan merging into an apical edge 58 which has a bottom locking surface 60 which extends normal to the axis of the neck portion. Above the ring 52 a limited bore surface 56 is of frusto-conical shape which widens toward its upper end to facilitate entry of the lower end portion 62 of the closure plug 28.

A portion 59 of the shoulder 52 diametrically opposite the sloping portion 56 is formed semi-cylindrical in shape and curved in plan about the axis X (FIG. 7) of the closure and provides an unobstructed downward entry for a contiguous portion of the shoulder the locking ring 66 on a cylindrical side wall 65 of the plug 28 so that the plug will locate in a canted position as shown in FIG. 4 upon its being initially pressed downwardly within the bore 50 as seen in FIG. 4. The radial extent L (FIG. 4) diametrically of the plug, serves as a lever between the point or area of application of force at P and the fulcrum point F in the region of the limited catch of the shoulder 66 under the shoulder 52. Since the plug will invariably cant when pressed-in, the natural inclination for the person closing the closure is to press at P. The leverage obtained multiplies the force application such that even a young child can, without much difficulty, snaps the closure shut.

The deformable annular locking ring or shoulder 66, which is of generally triangular cross-section having a lower downwardly tapered pilot surface 67, is forced past the apex 58 when the plug or cap is pressed into the neck opening or bore 50 whereupon an apical edge 68 on the plug ring 66 is deflected with edge 58 and the locking ring or shoulder 66 on the cap slips under the soulder 52 of the neck and a flat radially outwardly extending surface 69 at the upper end of the shoulder 66, normal to the axis of the neck or sleeve, locks under the face 60 in sealed engagement with the face 60.

The plug portion or cap 28 has a top wall 70 integral with the upper end of the plug 28, the wall 70 extending beyond the perimeter of the plug and forms an annular rim portion which on its underside is pressed in position against the top surface 75 of the annular flange 40 integral with and extending radially outwardly from the upper end of the neck portion 26. The bottom side 77 of flange 40 presses against the crest 78 (FIG. 3) of the curl 24 of the metal neck 14.

A tether in the form of a narrow strap 80 connects a peripheral edge of flange 72 with a peripheral edge of portion 40 of the neck member 26.

The wall 70 close to its marginal edge is provided with a vent opening 84 in an area diametrically opposite to the tether 80 adjacent to the interior surface of the wall 65 of the plug.

A frusto-conical pilot cavity 86 is formed at the upper end of opening 84 for guiding the male venting closure pin or element 30 which in the closed position extends into the opening 84.

The upper end of the closure element or vent pin 30 depends from and is integrally connected with the lever member 32 intermediate its ends. The lever 32 has a fulcrum end 96 which engages with the top edge of a combination pouring lip and fulcrum post 97 formed on the top side of the flange 40. The lever 32 is connected below the fulcrum end 96 to one end of a narrow strap 108 which is adapted to be folded and which has its other end connected to the outer edge of flange 72 in an area diametrically opposite the strap 80.

Thus, to open the closure shown closed in FIG. 3, the user inserts his finger through the ring hole 112 and lifts on portion 114 diametrically opposite the strap 108 thus lifting the fulcrum end portion 96 outwardly and withdrawing the vent plug 30 from opening 84. Continued rotation of the lever or handle engages the fulcrum portion 96 against the post or ledge 97 and further pivotal movement rightwardly (FIG. 3) pries the plug 28 out of the sleeve 26 as seen in FIG. 4. Removal of the pin or plug 30 removes the support for the plug wall 65 in the immediate area and thus enhances the flexure of that portion of the wall 65, that is, in the region of the vent opening whereby as the lever is fulcrumed, it pulls on the tether 108 which, in turn, curls the adjacent portion 72 of the top wall 70 upwardly and causes the portion of the wall 70 contiguous to the vent opening to warp radially inwardly thus facilitating partially unhooking of the ledge or shoulder 66 from under the shoulder 52 and disengaging the locking face 69 from face 60. The plug 28 then easily lifts out of the neck or sleeve opening and with the handle or lever portion 30 lays to one side of the pour opening 50 wherre it may be grasped by the user.

To reclose the closure, the plug 28 of the closure is pressed into the sleeve opening to canted position shown in FIG. 4 and then pressed at P to the closed position as shown in FIG. 5. Then the handle or lever is folded over the cap 28 and the vent plug or pin 30 is pressed into the vent opening 84.

I claim:

1. A flexible plastic closure for a container comprising a neck sleeve adapted to fit into an opening in a container, said neck sleeve having a bore providing a pour aperture, plug locking means on said neck sleeve extending radially into the bore, a plug insertable into said pour aperture for closing the container, said plug having locking means for interlocking engagement with said plug locking means on said neck sleeve upon full insertion of said plug into said neck sleeve, said locking means on said neck sleeve including means for guiding said plug in canted relation into said bore with a portion of said locking means on said plug entering into engagement with said plug locking means on said neck sleeve for operation as a fulcrum at one side of said plug whereby upon the application of an inwardly directed force on said plug at a point diametrically opposite said fulcrum said plug serves as a lever against said neck sleeve and swings about said fulcrum to facilitate full insertion of said plug into said bore and thereupon interlock both of said interlocking means with each other.

2. A closure for a container comprising a neck member having a bore, a plug member insertable into said bore, first means on said members for releasably interlocking each other attendant to insertion of said plug member into said bore, and second means for facilitating the insertion of said plug member into said bore in a forcing-in arrangement into interlocking engagement, at least one of said members being made of flexible plastic material, said second means including cooperatively disposed guide means for disposing said plug member in a finger-operable levered position, and said guide means including a partial truncated conical surface at the outer end of said bore merging circumferentially into a generally semi-cylindrical contoured surface.

3. A closure according to claim 2 and said truncated conical surface being at one side of the axis of said bore and said generally semi-cylindrical surface being at the opposite side of said axis.

4. A closure according to claim 3 and said plug member having a generally frusto-conical guide surface disposed in guided opposition to said surfaces on said neck member preparatory to insertion of said plug member.

5. A closure according to claim 2 wherein there is a hinge connection between said plug member and said neck member diametrically opposite said conical surface.

6. A closure for a container comprising a neck member having a bore, a plug member insertable into said bore, first means on said members for releasably interlocking each other attendant to insertion of said plug member into said bore, and second means for facilitating the insertion of said plug member into said bore in a forcing-in arrangement into interlocking engagement, at least one of said members being made of flexible plastic material, and said second means including means for guiding said plug member into a canted position in said bore with said interlocking means being in partial engagement at one side of the axis of said bore to provide a fulcrum for said plug member and said plug member serving as a lever against said neck member upon application of force to said plug member in an area diametrically opposite to said fulcrum.

7. A closure for a container comprising a neck member having a bore and a plug member insertable thereinto, said members having annular deformable interlocking locking rings which are deflectable to accommodate insertion and withdrawal of said plug member with respect to said bore, said neck member locking ring having different shaped guide surfaces on diametrically opposite sides of said bore, one of said guide surfaces providing for easy entry of one side of said plug member into said bore for initial disposition of said plug member in a canted position with contiguous portions of said locking rings in interlocked relation to provide a fulcrum about which said plug member may be swung by exerting a pressure on said plug member at the side thereof opposite said fulcrum to deflect the remaining portions of said locking rings into an interlocked sealing relation.

8. The closure according to claim 7 and said plug member having a continuous frustoconical surface disposed for guided engagement with said guide surfaces on said neck member.

9. The closure according claim 7 and said one surface being essentially semicylindrical and the other guide surface on the neck member being frustoconical and flaring axially outwardly.

10. A closure according to claim 7 wherein there is a hinge connection between said plug member and said neck member adjacent said one surface.

* * * * *